US006629873B2

(12) United States Patent
Shaw

(10) Patent No.: US 6,629,873 B2
(45) Date of Patent: Oct. 7, 2003

(54) SWINGING BOB TOY WITH MIDDLE BOB HAVING NON-CYLINDRICALLY SYMMETRIC WEIGHT DISTRIBUTION

(76) Inventor: Laurence J. Shaw, 338 Third Ave., #1, San Francisco, CA (US) 94118

( * ) Notice: Subject to any disclaimer, the term of this patent is extended or adjusted under 35 U.S.C. 154(b) by 94 days.

(21) Appl. No.: 10/113,611

(22) Filed: Apr. 1, 2002

(65) Prior Publication Data

US 2003/0008596 A1 Jan. 9, 2003

Related U.S. Application Data

(60) Provisional application No. 60/303,981, filed on Jul. 9, 2001.

(51) Int. Cl.[7] ..... A63H 33/00
(52) U.S. Cl. ..... 446/490; 446/247; 446/242
(58) Field of Search ..... 446/490, 247, 446/215, 252, 489, 242

(56) References Cited

U.S. PATENT DOCUMENTS

| | | | | |
|---|---|---|---|---|
| 93,249 | A | * | 8/1869 | Trebe |
| 113,654 | A | | 4/1871 | Harbison |
| 672,099 | A | | 4/1901 | Jackson |
| 801,145 | A | | 10/1905 | Feltner |
| 1,241,000 | A | | 9/1917 | Mulvey |
| 1,780,385 | A | | 11/1930 | Guyot |
| 1,932,943 | A | * | 10/1933 | Smith |
| 2,071,041 | A | | 2/1937 | Maggio |
| 2,161,154 | A | * | 6/1939 | Gertler |
| 2,429,027 | A | | 10/1947 | Myers |
| 3,325,940 | A | * | 6/1967 | Davis |
| 3,940,878 | A | | 3/1976 | Panico ..... 46/47 |
| 4,878,868 | A | * | 11/1989 | Shaw ..... 446/75 |
| 5,145,444 | A | * | 9/1992 | VanKuiken ..... 446/242 |
| RE34,208 | E | * | 3/1993 | Shaw ..... 446/75 |
| 6,332,851 | B1 | * | 12/2001 | Griffin ..... 473/577 |

FOREIGN PATENT DOCUMENTS

| | | | |
|---|---|---|---|
| DE | 592723 | 1/1934 | ..... 77/26.06 |
| FR | 980844 | 6/1948 | |

OTHER PUBLICATIONS http://scienceworld.wolfram.com/physics/Momentoflnertia.*
http://oldsci.eiu.edu/physics/DDavis/1150/14Thermo/engines.*
http://physics.bu.edu/py105/notes/Heatengines.*
Packaging for "OY–OY The Backward Yo–Yo," Playco Plastics, Inc., Lincoln, Massachusetts, 1971.

* cited by examiner

*Primary Examiner*—Derris H. Banks
*Assistant Examiner*—Ali Abdelwahed
(74) *Attorney, Agent, or Firm*—Integral Patent Associates

(57) ABSTRACT

A swinging bob toy having a middle bob with a non-cylindrically symmetric internal structure. The center of mass is located near the middle of the bore axis, and the percentage azimuthal variation V in the moment of inertia I about an axis in the equatorial plane, given by $$V=100\times[I(\phi_{max})-I(\phi_{min})]/I(\phi_{max}),$$

is minimized, for instance by positioning the internal components to produce a weight distribution with n-fold symmetry, where n≧3. In one preferred embodiment, the bobs are equipped with lights powered by on-board batteries. Flat cylindrical batteries are mounted on an equatorial circuit board with their axes of symmetry perpendicular to the bore axis. To allow battery replacement, the top and bottom halves of each bob are removably attached by screw-secured posts parallel to, but offset from, the bore axis. An on/off switch is accessible via a small aperture through a transparent outer shell. In one preferred embodiment, the lights flash at a frequency which is not visible when the bobs are stationary, but visible when the bobs are in motion.

28 Claims, 7 Drawing Sheets

SWINGING BOB TOY WITH MIDDLE BOB HAVING NON-CYLINDRICALLY SYMMETRIC WEIGHT DISTRIBUTION

REFERENCE TO RELATED APPLICATIONS

The present non-provisional application claims the benefit of priority from provisional patent application Ser. No. 60/303,981, filed Jul. 9, 2001, by the same inventor and having the same title.

BACKGROUND OF THE INVENTION

The present invention is directed to swinging bob toys, more particularly to swinging bob toys where the middle bob does not have a cylindrically-symmetric weight distribution, and even to swinging bob toys where the middle bob has few or no weight-distribution symmetries. One group of embodiments of particular importance for swinging bob toys where the weight distribution of the middle bob does not have cylindrical symmetry is swinging bob toys where the middle bob includes functional, internal components, such as one or more light-emitting elements powered by one or more electric batteries.

As shown in FIG. 1A, a swinging bob toy (100) consists of an end bob (110) and a cylindrically-symmetric bored bob (111) on a string (120). The end bob (110) is fixed at an end (121) of the string (120). The bored bob (111) has a bore (130) through which the string (120) passes, thereby allowing the bored bob (111) to slide freely along the string (120). As shown in FIG. 1B, the toy (100) is operated by holding the end (122) of the string opposite the end (121) where the end bob (110) is attached, and oscillating the hand (141) to cause the bobs (110) and (111) to separate and the end bob (110) to orbit about the bored bob (111). The bobs (110) and (111) can describe a vertical orbit (190), as shown in FIG. 11B, or horizontal orbits, figure-eight type orbits or irregular paths.

The above-described swinging bob toy (100) is described in German Patent No. 572723 issued in February of 1934, and a version of this toy (100) was marketed by Playco Plastics of Lincoln, Mass. under the trademark "OY—OY." It should be noted that the German patent and Playco Plastics teach that the density of the bored bob (111) is cylindrically symmetric about the bore axis (136) and has a homogeneous density. A disadvantage of the homogeneous density of the bored bob (111) is that the string (120) tends to snag around the bored bob (111) as the bobs (110) and (111) orbit, inhibiting the enjoyment of operation of the toy (100).

An improved version of the swinging bob toy (200) is described in U.S. Pat. No. Re. 34,208 issued Mar. 30, 1993. As shown in FIG. 2, the improved swinging bob toy (200) consists of three bobs (210), (211) and (212) on a string (220), with end bobs (210) and (212) being fixed at the ends (221) and (222) of the string (220), and the middle bob (211) having a bore (230) through which the string (220) passes, thereby allowing the middle bob (211) to slide along the string (220). Having a bob (210)/(212) fixed at each end (221)/(222) of the string (220) allows a player to hold either end bob (210)/(212) during operation and perform juggling tricks, such as switching end bobs (210)/(212) in mid-air. (In this paragraph and the remainder of the Background of Invention section, the 200-series reference numerals of FIGS. 2, 3A and 3B, rather than the 100-series reference numerals of FIGS. 1A and 1B, will be used in discussions of swinging bob toys. Furthermore, components of the swinging bob toy other than those of the middle bob (211) will be assigned 200-series reference numerals corresponding to the 100-series reference numerals of FIGS. 1A and 1B.)

As shown in the cut-away view of the middle bob (211) of FIG. 3A and the cross-sectional view of FIG. 3B, one of the innovations of the swinging bob toy (200) of U.S. Pat. No. Re. 34,208 is a high-density weight (240) centered within a low-density surrounding material (250). In a swinging bob toy marketed under the trademark AstroJax®, and having been distributed by New Toy Classics of San Francisco, Calif., United States, and Active People of Benningen, Switzerland, the weight (240) is made of brass and is essentially cylindrical with a central bore (232) along the axis of cylindrical symmetry (235) (i.e., the "polar axis") of the bob (211). The material (250) surrounding the weight (240) is a soft foam having a density of roughly 0.4 g/cc. The exterior surface (251) of the foam bob (211) is spherical, with the exception of two conical-section indents (231) at the top and bottom which lead to the bore (232) of the weight. The bore (230) of the bob (211) consists of the indents (231) in combination with the bore (232) of the weight (240). The mouth (234) of each conical-section indent (231) is rounded to meet the outside spherical surface (251).

The function of the high-density weight (240) is to concentrate the mass near the center of the bob (211), providing a low moment of inertia I about axes perpendicular to the polar axis (235), thereby allowing the middle bob (211) to rotate rapidly as the swinging outer bob (212) describes the top (291) of its orbit (290). This is the same principle that a diver uses when she tucks into a bob during a dive to complete more rotations, or an ice skater uses when he brings his anus in during a spin to rotate faster.

A particularly popular embodiment of the swinging bob toy (200) is a glow-in-the-dark version where the foam (250) surrounding the central weight (240) is impregnated with a phosphorescent pigment. When the phosphorescent pigment is exposed to light, the energy is absorbed and stored by the pigment, and then re-emitted as light over a period of ten to fifteen minutes. A user may therefore 'charge' up the bobs (210), (211) and (212) under bright light, and then play with the luminescent bobs (210), (211) and (212) in a dark area for the ten to fifteen minutes during which the bobs (210), (211) and (212) re-emit light. This provides the swinging bob toy (200) in its purest visual form, since the surrounding environment, and even the string (220) connecting the bobs (210), (211) and (212), is not visible.

The glow-in-the-dark embodiment of the swinging bob toy (200) has been enjoyed by children, as well as adults playing in nightclubs and rave parties. However, its enjoyment and popularity is limited by the inconvenience of needing to frequently recharge the pigment in the bobs (210), (211) and (212). Therefore, there has been demand for a battery-powered, light-emitting embodiment of the swinging bob toy (210), (211) and (212) for several years.

As discussed in U.S. Pat. No. Re. 34,208, a crucial measure of the "goodness of operation" of a swinging bob toy (200) is the dimensionless ratio X given by $$X=(mh^2/I)^{1/2}, \tag{1.1}$$

where I is the moment of inertia about axes perpendicular to the polar axis (235), m is the mass of each bob, and h is the height of the bore. It should be noted that this expression is only applicable for a middle bob (211) having cylindrical symmetry, so that the moment of inertia I is not a function of the azimuthal angle $\phi$ of the axis of rotation for which the moment of inertia I is calculated. If X is much greater than unity, the middle bob (211) can rotate rapidly in response to the torque produced by the string (220), and so the string (220) will not snag around the middle bob (211) and the motion will be smooth. However, if X is much less than unity, the middle bob (211) cannot rotate rapidly in response to the torque produced by the string (220), and so the string (220) will tend to snag, or even tangle, around the middle bob (211), disrupting the orbital motions of the bobs (210) and (211) and inhibiting enjoyment of the toy (200).

The design of a light-up version of the swinging bob toy (200) is further complicated by the fact that the functional, internal components in the middle bob (211) will typically produce a mass distribution which is not cylindrically symmetric, and may even have few or no symmetries. Furthermore, the functional, internal components will generally have considerable mass, and it will be difficult or impossible to position the functional, internal components near the center of the bob due to their dimensions.

Therefore, it is an object of the present invention is to provide a swinging bob toy having a middle bob without a cylindrically-symmetric weight distribution which has a moment of inertia as a function of azimuthal angle which prevents snagging or tangling of the string about the middle bob.

It is another object of the present invention is to provide a swinging bob toy having a middle bob without a cylindrically-synmmetric weight distribution which has one or more low moments of inertia.

It is another object of the present invention is to provide a swinging bob toy with a middle bob having weight-distribution symmetries producing one or more low moments of inertia.

It is another object of the present invention is to provide a swinging bob toy with a middle bob having few or no weight-distribution symmetries which has one or more low moments of inertia.

It is another object of the present invention is to provide a swinging bob toy having a middle bob without a cylindrically-symmetric weight distribution which has a minimum in variation of the moment of inertia as a function of axis of rotation.

It is another object of the present invention is to provide a swinging bob toy with a middle bob having weight-distribution symmetries which has a minimum in variation of the moment of inertia as a function of axis of rotation.

It is another object of the present invention is to provide a swinging bob toy with a middle bob having few or no weight-distribution symmetries which has a minimum in variation of the moment of inertia as a function of axis of rotation.

Moreover, it is an object of the present invention to provide some or all of the above-listed objects for a middle bob having functional, internal components.

It is another object of the present invention is to provide a swinging bob toy having a middle bob with functional, internal components which includes a means for securing top and bottom halves of the middle bob, and which has one or more low moments of inertia.

It is another object of the present invention to provide a light-emitting toy having a dramatic appearance.

It is another object of the present invention is to provide a battery-powered light-emitting embodiment of the swinging bob toy.

It is another object of the present invention is to provide a light-emitting swinging bob toy where the lights flash at a frequency that is rapid enough that the flashing cannot be detected by the human eye when the bobs are stationary, but becomes detectable when the bobs have a velocity associated with normal play.

Furthermore, it is an object of the present invention is to provide a light-emitting swinging bob toy where the lights appear not to flash when the bobs are stationary, but appear to flash when the bobs have a velocity associated with normal play, where this change in appearance is accomplished without use of a motion detecting mechanism.

Also, it is an object of the present invention is to provide a light-emitting swinging bob toy where the lights appear not to flash when the bobs are stationary, but appear to flash when the bobs have a velocity associated with normal play, where this change in appearance is accomplished by taking advantage of the physiological and/or psychophysiological qualities of human visual perception.

It is another object of the present invention is to provide a battery-powered light-emitting embodiment of the swinging bob toy having one or more of the above-listed objects.

Additional objects and advantages of the invention will be set forth in the description which follows, and will be apparent from the description or may be learned from the practice of the invention. The objects and advantages of the invention may be realized and obtained by means of the instrumentalities and combinations particularly pointed out in the claims.

SUMMARY OF THE PRESENT INVENTION

The present invention is directed to a swinging bob toy having a first bob attached at the end of a string, and a second bob having a bore through which the string passes, allowing the second bob to slide along the string. The second bob has a mass distribution which does not have cylindrical symmetry about an axis along the bore, i.e., the polar axis. The percentage moment variation V is defined as $$V=100\times[I(\phi_{max})-I(\phi_{min})]/I(\phi_{max}),$$

where $\phi$ is the azimuthal angle of an axis of rotation in the equatorial plane normal to the polar axis, $\phi_{max}$ is the azimuthal angle of the axis of rotation at which the moment of inertia I has its maximum value, and $\phi_{min}$ is the azimuthal angle of the axis of rotation at which the moment of inertia I has its minimum value. The percentage moment variation V has a value of less than 66%, and the mass distribution has a center of mass located near the middle of the bore axis.

The present invention is directed to a swinging bob toy having a first bob attached at the end of a string of length l, and a second bob having a bore through which the string passes, allowing the second bob to slide along the string. A light in one of the bobs is connected to circuitry to produce a flashing of the light at a rate N, with the light being off for a fraction $\alpha$ of the flashing cycle. If the viewer is a distance D from the swinging bob toy, the flashing occurs at a rate N within the bounds $$10Hz<N<200\alpha\sqrt{gl}/D,$$

where g is the acceleration due to gravity, so that said flashing is not visible when the light is stationary, but is visible during operation of the toy.

BRIEF DESCRIPTION OF THE FIGURES

The accompanying figures, which are incorporated in and form a part of this specification, illustrate embodiments of the invention and, together with the description given above and the detailed description of the preferred embodiments given below, serve to explain the principles of the invention.

DETAILED DESCRIPTION OF THE PREFERRED EMBODIMENTS

Middle Bob with Functional, Internal Components

Figure 3A:
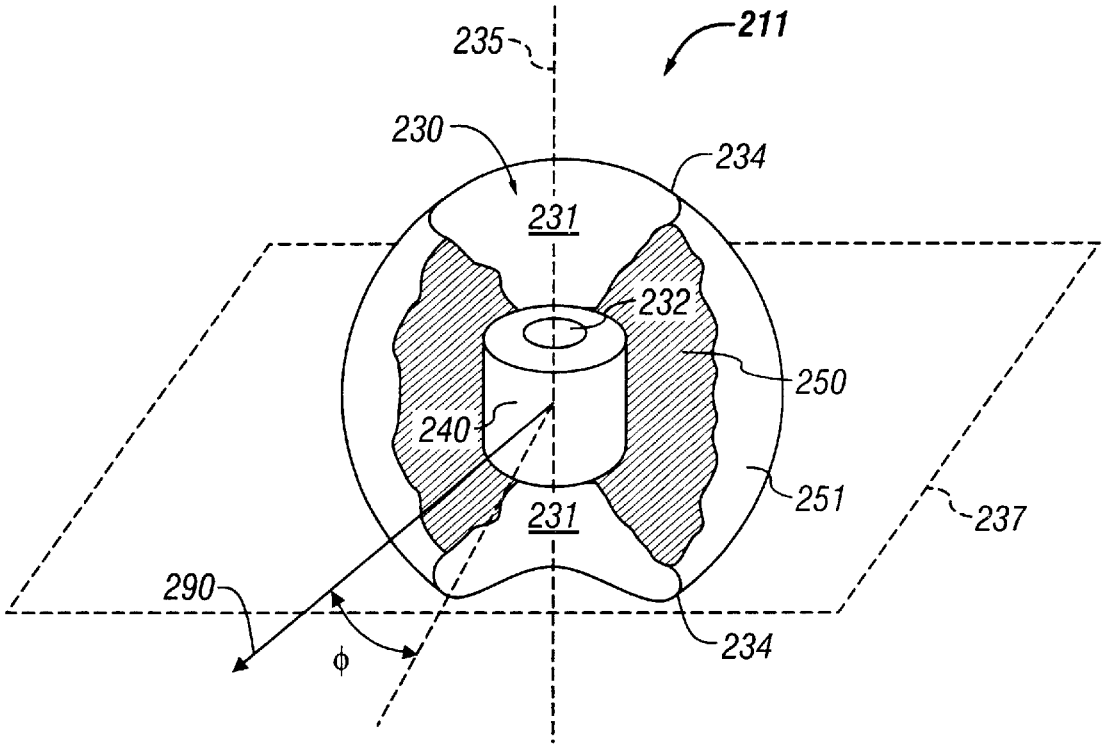
FIG. 3A (Prior Art)
FIG. 3A shows a cut-away view of the middle bob having a mass distribution as described in the prior art, i.e., having cylindrical symmetry with a high density central weight inside a cylindrically-symmetric, homogeneous, low-density material.
Figure 3B:
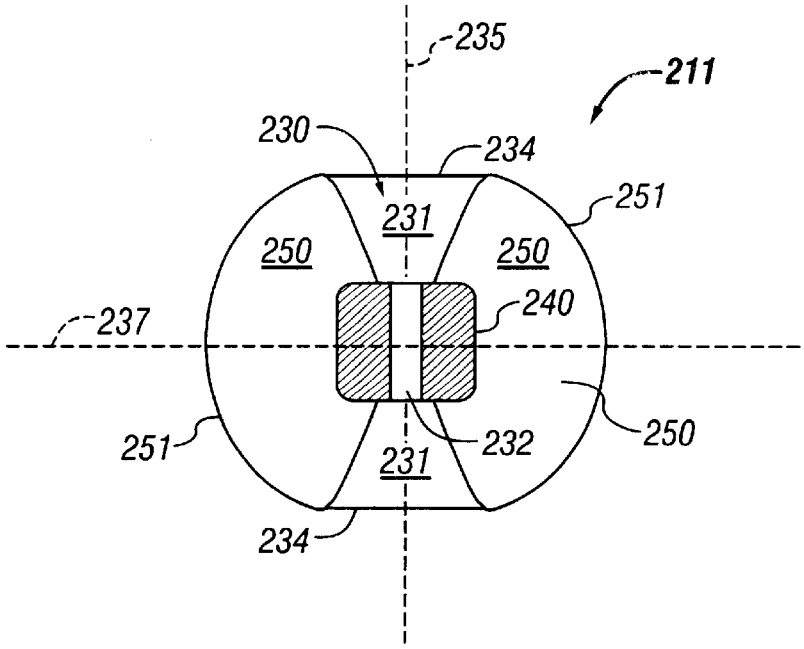
FIG. 3B (Prior Art)
FIG. 3B shows a cross-sectional view of the middle bob of FIG. 3A.
Figure 3C:
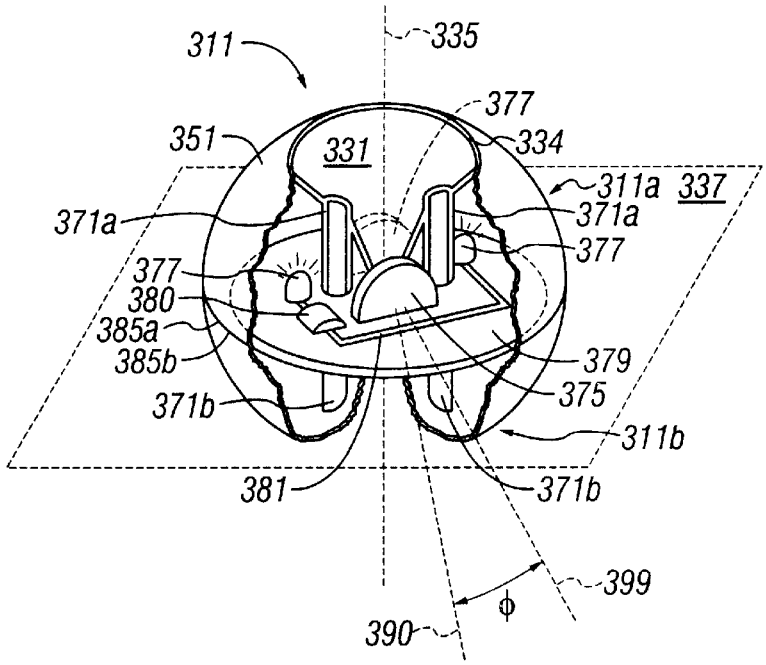
FIG. 3C shows a cut-away view of a middle bob having a mass distribution lacking cylindrical symmetry due to functional, internal components.

A cut-away view of a battery-powered light-emitting middle bob (311) is shown in FIG. 3C. The bob (311) has a transparent or translucent outer shell (351) with an exterior surface which is spherical, with the exception of a bore (331) through the bob (311). The bore (331) is wider at its mouth (334) where it meets the spherical surface than at its center. The bore axis (335) is normal to an equatorial plane (337). The outer shell (351) consists of an upper, substantially-hemispheric portion (311*a*) having a lower equatorial edge (385*a*), and a lower, substantially-hemispheric portion (311*b*) having an upper equatorial edge (385*b*). The lower portion (311*b*) has two lower screw posts (371*b*) which are hollow and threaded, and the upper portion (311*b*) has two upper screw posts (371*a*) which are hollow and have a diameter wide enough that screws (not shown) may be put into the upper screw posts (371*a*) and screwed into the lower screw posts (371*b*), thereby securing the upper and lower portions (311*a*) and (311*b*) of the bob (311) together.

It should be noted that, generally, the screw posts (371*a*) and (371*b*) and screws are more massive than mechanisms for securing the two hemispheres (311*a*) and (311*b*) which could be located at the equatorial edges (385*a*) and (385*b*). For instance, the equatorial edges (385*a*) and (385*b*) might have integrally-formed complementary threadings or a snap-lock mechanism. However, the contribution to the moment of inertia I from such integrally-formed mechanisms at the equatorial edges (385*a*)/(385*b*) will generally be greater than the contribution from the more-massive screw posts (371*a*) and (371*b*) and screws, due to the radius-squared weighting of the moment of inertia I The interior of the bob (311) is hollow, and inside the bob (311) is a circuit board (379) on the equatorial plane (337), on which two batteries (375), four lights (377), and an on-off switch (380) are mounted. The battery (375) which is predominantly behind a portion of the bore (331) is depicted with a dashed outline. Because the circuit board (379) is not translucent, two lights (377) are mounted on the top of the circuit board (379), and two lights (not visible in FIG. 3C) are mounted on the bottom surface of the circuit board (379). The on-off switch (380) is electrically connected between the batteries (375) and the lights (377) by imprinted wires (381). A small aperture (not shown) in the shell (351) directly above the on-off switch (380) allows the state of the switch (380) to be altered by pressing on the top surface of the switch (380) with an elongated probe (not shown) inserted through the aperture.

In the preferred embodiment, the batteries (375) are small, thin, disk-shaped camera batteries or hearing-aid batteries. It should be noted that the batteries (375) are mounted on the circuit board (379) in a non-standard fashion with their axes of cylindrical symmetry orthogonal to the polar axis (335) of the bob (311). This allows the center of mass of each battery (375) to be nearer the center of the bob (311) than if it (375) was mounted with the axis of cylindrical symmetry parallel to the polar axis (335). It should also be noted that because the bore (331) flares outwards on both sides of the center of the bore (331), the diameter of the batteries (375) limits how near the center of the bob (311) the batteries (375) can be located. Therefore, in general, the contribution to the moment of inertia I from a plurality of less powerful components will be less than the contribution from fewer, more powerful, components.

Figure 1A:
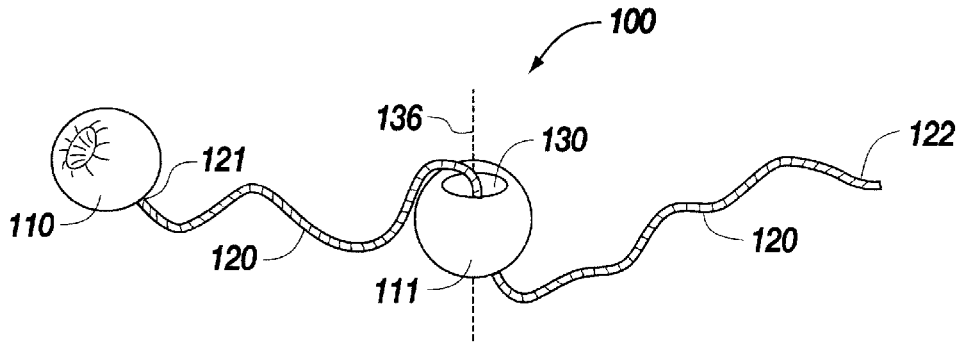
FIG. 1A shows a swinging bob toy having two bobs.
Figure 1B:
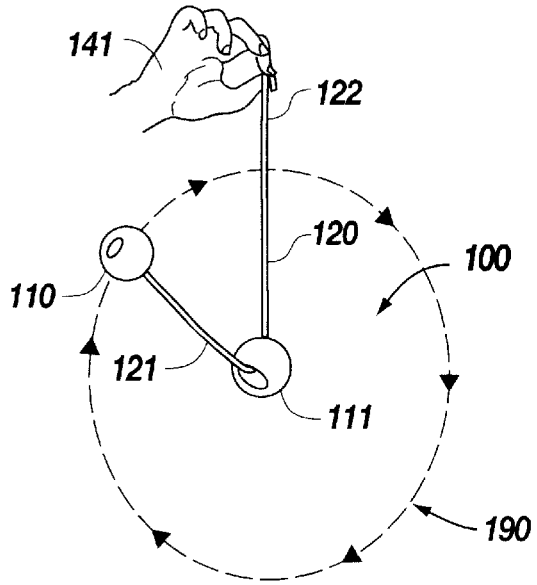
FIG. 1B shows operation of the swinging bob toy of FIG. 1A with the bobs describing a vertical orbit.
Figure 2:
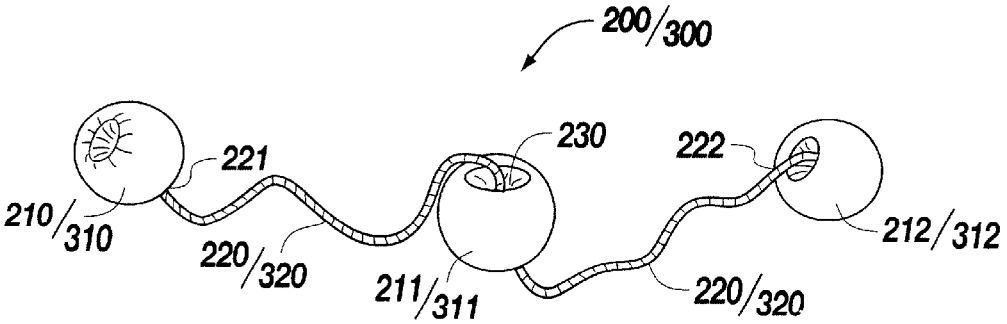
FIG. 2 shows a swinging bob toy having three bobs.

In the remainder of the present specification, 300-series reference numerals of FIG. 3C will be used in discussions of swinging bob toys where the middle bob (311) has a non-cylindrically symmetric weight distribution. Furthermore, components of the swinging bob toy other than those of the middle bob (311) will be assigned 300-series reference numerals corresponding to the 200-series reference numerals of FIGS. 2, 3A and 3B, and the 100-series reference numerals of FIGS. 1A and 1B. For instance, the string of a swinging bob toy (300) where the middle bob (311) has a non-cylindrically symmetric weight distribution will be assigned the reference numeral "320," and the end bobs will be assigned the reference numerals "310" and "312."

The Moment of Inertia

The moment of inertia I of a middle bob (311) about an axis of rotation (390) in the equatorial plane (337) at an azimuthal angle $\phi$ from the reference direction is given by $$I(\phi)=\int \rho r(\phi)^2 d\tau, \tag{2.1}$$

where $\rho$ is density, $r(\phi)$ is distance from the axis of rotation (390), $d\tau$ is an infinitesimal volume element, and the integration is performed over volume. Or, in terms of a number of point masses $m_l$ at distances $r_i(\phi)$ from the axis of rotation (390), the moment of inertia $I(\phi)$ is given by $$I(\phi)=\Sigma_i m_i r_i(\phi)^2. \tag{2.2}$$

Because, the contribution to the moment of inertia $I(\phi)$ from each component is a function of the square of the distance $r(\phi)$ from the axis of rotation (390), the moment of inertia $I(\phi)$ is very sensitive to the placement of components. The dependence of the moment of inertia I(ϕ) on the second power of the distance r(ϕ) from the axis of rotation (390) is somewhat non-intuitive since non-rotational dynamics does not have any relevant quantities with a similar radius-squared weighting. For instance, if a small, heavy component is moved from 2 mm to 4 mm from the axis of rotation (390), its contribution to the moment of inertia I is increased by a factor of four, rather than the more-intuitive factor of two. Or, if a small, heavy component is moved from 1 mm to 3 mm from the axis of rotation (390), its contribution to the moment of inertia I is increased by a factor of nine, rather than the more-intuitive factor of three.

The design of a swinging bob toy (300) with functional, internal components in the middle bob (311) becomes problematic because the functional, internal components will typically have considerable mass, and will be difficult to position near the center of a bob (311) due to their dimensions. Furthermore, a swinging bob toy (300) having functional, internal components will typically have a middle bob (311) with a moment of inertia I which varies depending on the azimuthal angle ϕ of the axis of rotation (390) in the equatorial plane (337).

Figures 1, 6:
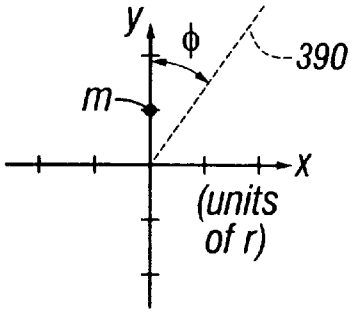
FIGS. 6.1 through 6.4 depict point masses located around the origin having one-fold, two-fold, three-fold, and four-fold symmetries, respectively.
Figures 2, 6:
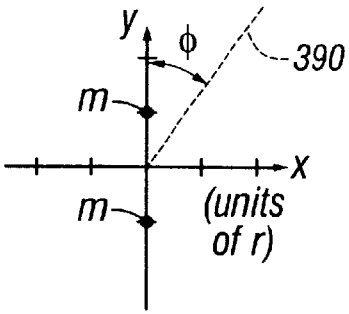
Figures 3, 6:
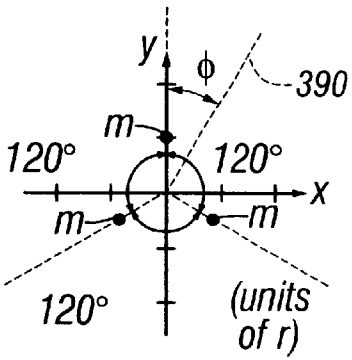
Figures 4, 6:
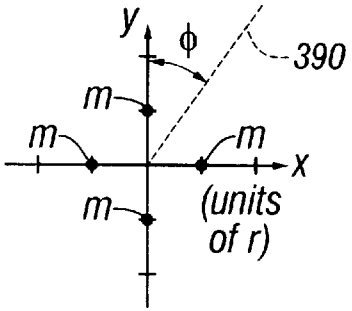

It is instructive to consider the dependence of the moment of inertia I on the azimuthal angle ϕ of the axis of rotation (390) for n point masses of mass m located in a plane with n-fold symmetry at a distance r from the origin. One, two, three and four point masses located in a plane with one-fold, two-fold, three-fold and four-fold symmetry about the origin are depicted in FIGS. 6.1, 6.2, 6.3 and 6.4, respectively. Polar plots of the moment of inertia I as a function of azimuthal angle ϕ for the geometries of FIGS. 6.1, 6.2, 6.3 and 6.4 are depicted in FIGS. 7.1, 7.2, 7.3 and 7.4, respectively.

Figures 1, 7:
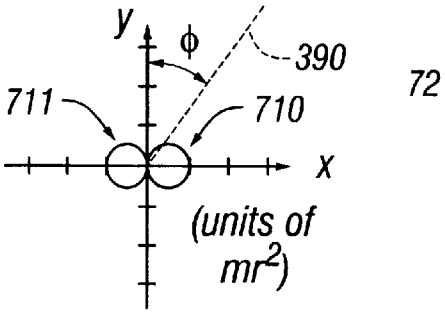
FIGS. 7.1 through 7.4 are polar plots of the moment of inertia I of the point masses of FIGS. 6.1 through 6.4 as a function of azimuthal angle $\phi$ of the axis of rotation.
Figures 2, 7:
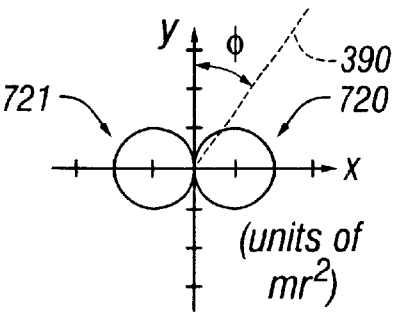
Figures 3, 7:
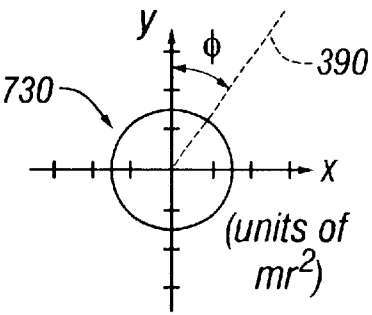
Figures 4, 7:
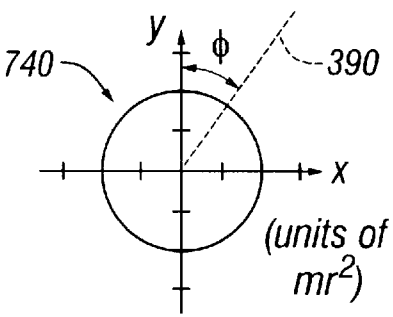

For a single mass m located on the y-axis at a distance r from the origin, as is shown in FIG. 6.1, the moment of inertia I as a function of the azimuthal angle ϕ of the axis of rotation (390) has two lobes (710) and (711) on the x-axis with each lobe (710)/(711) being wider in the x direction than in the y direction, as is shown in FIG. 7.1. When the axis of rotation (390) is along the line between the origin and the mass m, i.e., when ϕ=0° or ϕ=180°, the moment of inertia I has a value of zero. When the axis of rotation (390) is along the positive or negative x-axis, i.e., when ϕ=±90°, the moment of inertia I has its value of (m $r^2$).

Similarly, for a mass m located on the positive y-axis at a distance r from the origin and a mass m located on the negative y-axis at a distance r from the origin (i.e., two masses of mass m distributed about the origin at a distance r with two-fold symmetry), as is shown in FIG. 6.2, the moment of inertia I as a function of the azimuthal angle ϕ of the axis of rotation (390) is again a function having two lobes (720) and (721) on the x-axis, as is shown in FIG. 7.2, with the lobes (720) and (721) having same shape as the lobes (710) and (711) shown in FIG. 7.1. When the axis of rotation (390) is along the line between the masses m, i.e., when ϕ=0° or ϕ=180°, the moment of inertia I has a value of zero. When the axis of rotation (290) is along the positive or negative x-axis, i.e., when ϕ=±90°, the moment of inertia I has its value of (2 m $r^2$).

For a mass m located on the positive y-axis at a distance r from the origin, a mass m located at +120° from the positive y-axis at a distance r from the origin, and a mass m located at −120° from the positive y-axis at a distance r from the origin (i.e., three masses of mass m distributed about the origin at a distance r with three-fold symmetry), as is shown in FIG. 6.3, the moment of inertia I as a function of the azimuthal angle ϕ of the axis of rotation (390) is a constant of magnitude (3 m $r^2$/2), and is therefore shown in the polar plot of FIG. 7.3 as a circle (730) of radius (3 m $r^2$/2). Similarly, for masses of mass m located on the positive and negative y-axes and the positive and negative x-axes at a distance r from the origin (i.e., four masses of mass m distributed about the origin at a distance r with four-fold symmetry), as is shown in FIG. 6.4, the moment of inertia I as a function of the azimuthal angle ϕ of the axis of rotation (390) is a constant of magnitude (2 m $r^2$), and is therefore plotted as a circle (740) in FIG. 7.4. More generally, it can be shown that for all integer values of n greater than or equal to 3, n masses of equal mass m distributed about the origin with n-fold symmetry will have a moment of inertia I which is invariant with azimuthal angle ϕ of the axis of rotation (390) and has a magnitude of (n m $r^2$/2).

The Percentage Moment Variation

Figure 8:
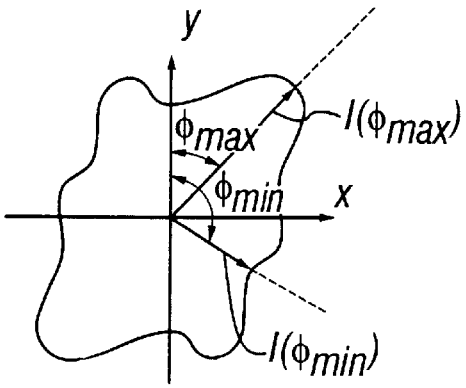
FIG. 8 illustrates an exemplary polar plot of the moment of inertia I of a bob having functional, internal components.

According to the present invention, the percentage moment variation V of the moment of inertia I(ϕ) is defined as $$V=100\times[I(\phi_{max})-I(\phi_{min})]/I(\phi_{max}), \tag{3.1}$$

where $\phi_{max}$ is the azimuthal angle of the axis of rotation (390) at which the moment of inertia I is a maximum, and $\phi_{min}$ is the azimuthal angle of the axis of rotation (390) at which the moment of inertia I is a minimum. From FIGS. 7.1 through 7.4 it can be seen that the percentage moment variation V has a value of 100% for one-fold and two-fold symmetries, and a value of 0% for n-fold symmetries where n≧3. A polar plot of the moment of inertia I(ϕ) for a bob with functional, internal components will generally be an irregular shape which is necessarily symmetric through the origin, i.e., I(ϕ)=I(ϕ+180°), as shown in FIG. 8, and, generally, the percentage moment variation V will have a value somewhere between 0% and 100%.

Behavior of the Middle Bob During the String Pass

As discussed in U.S. Pat. No. Re. 34,208 (column 3, lines 32–57), high-speed photography shows that for a swinging bob toy (200) with a middle bob (211) having a cylindrically-symmetric density and a low moment of inertia, the rotation of the middle bob (211) has two different modes of motion as the end bob (210) describes the top of its orbit where it passes by the string (220), i.e. when the end bob (210) performs its "string pass."

Figure 4A:
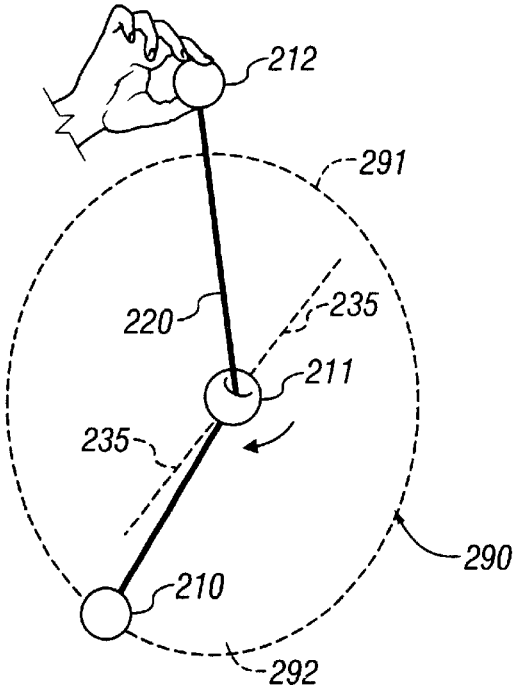
FIGS. 4A–4D depict a first mode of rotation of the middle bob about its center as the swinging bob passes the top of its orbit.
Figure 4B:
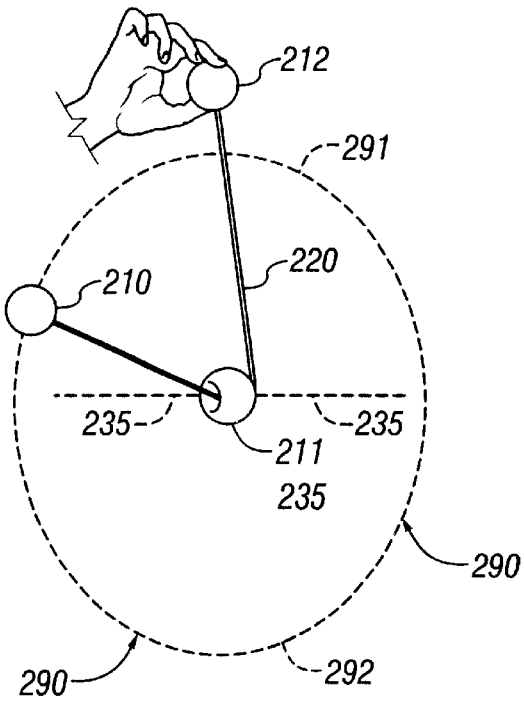
Figure 4C:
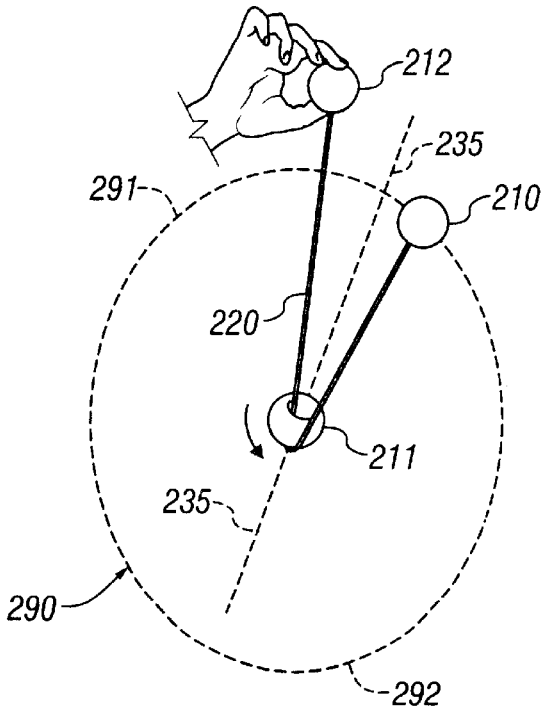
Figure 4D:
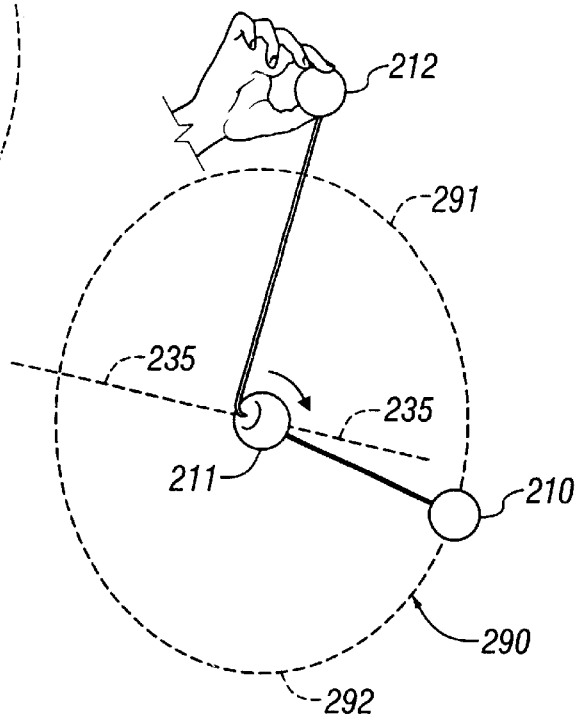

In a first mode of motion, the bore axis (235) of the middle bob (211) rotates to roughly follow the path of the swinging end bob (210) as it (210) describes the lower half (292) of its orbit (290), as is indicated by the clockwise arrow next to the middle bob (211) in FIG. 4A. But as the swinging end bob (210) begins the upper half (291) of its orbit (290), the rotation of the middle bob (211) slows and stops, as indicated by the lack of an arrow next to the middle bob (211) in FIG. 4B. Then, during the upper half (291) of the orbit (290) of the swinging end bob (210), the middle bob (211) reverses its direction of rotation, as is indicated by the counter-clockwise arrow next to the middle bob (211) in FIG. 4C. By the time the swinging end bob (210) begins the lower half (292) of its orbit (290), the middle bob (211) has completed a 180° rotation, and again the bore axis (235) roughly points towards the swinging end bob (210), as is shown in FIG. 4D.

Figure 5A:
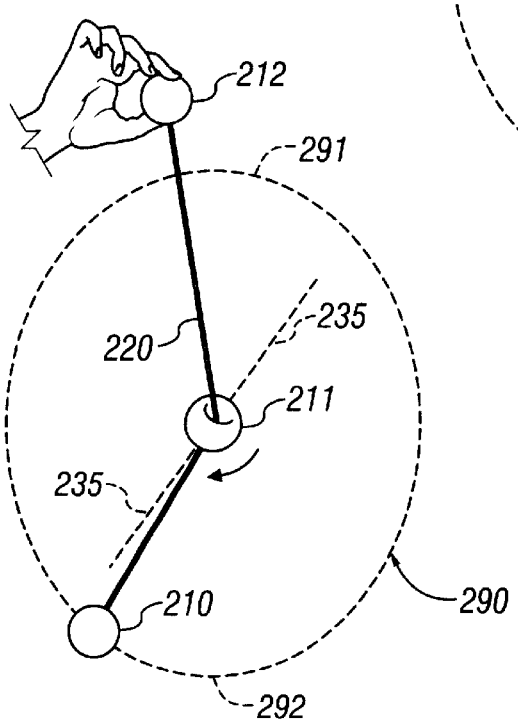
FIGS. 5A–5D depict a second mode of rotation of the middle bob about its center as the swinging bob passes the top of its orbit.
Figure 5B:
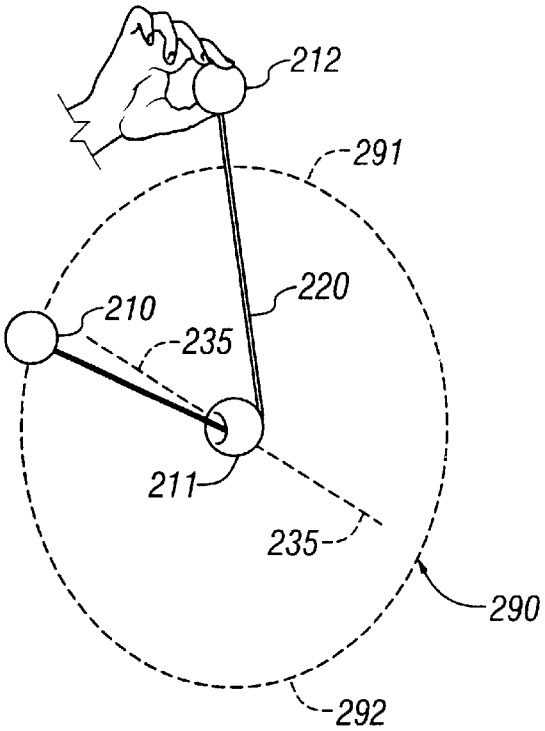
Figure 5C:
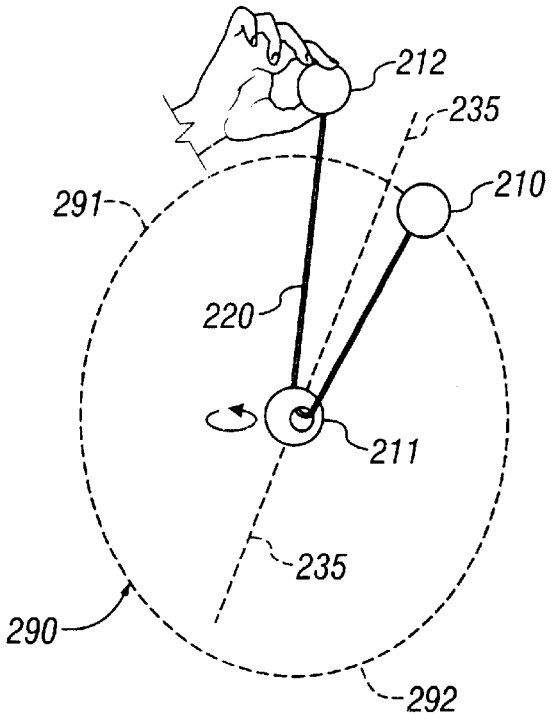
Figure 5D:
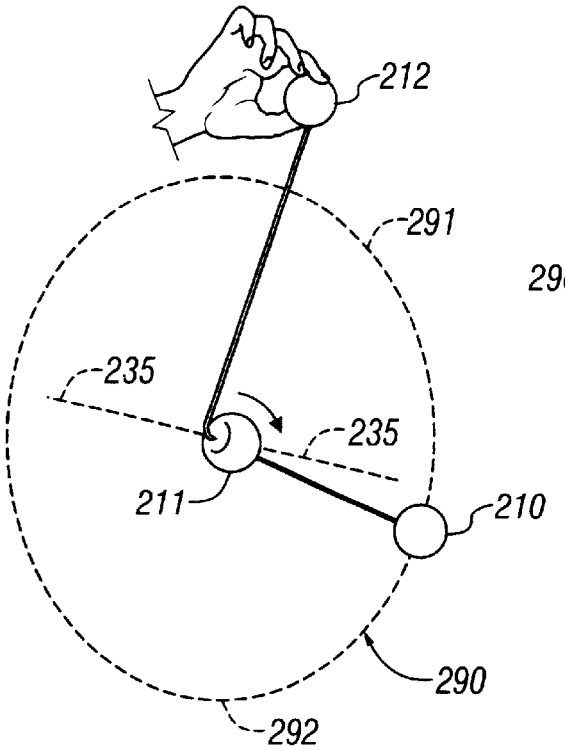

In a second mode of motion, the bore axis (235) of the middle bob (211) rotates to roughly follows the path of the swinging end bob (210) as it (210) describes the lower half (292) of its orbit (290), as is indicated by the clockwise arrow next to the middle bob (211) in FIG. 5A. But as the swinging end bob (210) begins the upper half (291) of its orbit (290), the rotation of the middle bob (211) slows and stops, as indicated by the lack of an arrow next to the middle bob (211) in FIG. 5B. Then, during the upper half (291) of the orbit (290) of the swinging end bob (210), the middle bob (211) rotates in the horizontal plane to the side of the string (220) on which the outer bob (210) will pass, as is indicated by the arrow coming out of the page next to the middle bob (211) in FIG. 5C. By the time the swinging end bob (210) begins the lower half (292) of its orbit (290), the middle bob (211) has completed a 180° rotation, and again the bore axis (235) roughly points towards the swinging end bob (210), as is shown in FIG. 5D.

Hybrid motions of the middle bob (211), combining or alternating between the first and second modes of motion, are also possible. For instance, in the course of its 180° rotation, the middle bob (211) may begin to rotate counter-clockwise in the vertical plane, then rotate in the horizontal plane, and then rotate counter-clockwise again in the vertical plane. Or the middle bob (211) may rotate in an arc that is mid-way between the vertical and horizontal planes.

However, it has been found that the rotation of the middle bob (311) is somewhat more erratic and unpredictable during the string pass when the middle bob (311) has a large percentage moment variation V, than when the middle bob (311) has a small percentage moment variation V (e.g., when the middle bob (311) has a cylindrically-symmetric weight density). This is apparently attributable to the fact that the rotation of a middle bob (311) with a non-zero percentage moment variation V is complicated by its azimuthal orientation during the string pass.

One might suspect that during the string pass, the middle bob (311) would rotate about the axis at the azimuthal angle $\phi_{min}$ at which the moment of inertia I is smallest, based on the assumption that a minimization principle—similar to the potential energy minimization principle that explains why water tends to flow along the most downhill route—would apply. Although this does occur during some string passes, slow-motion videography indicates that this is not always the case. Even when the minimum moment of inertia $I(\phi_{min})$ is substantially smaller than the maximum moment of inertia $I(\phi_{max})$, the middle bob (311) may rotate about an axis having a large moment of inertia I during the string pass, making it likely that the string (320) will snag or tangle about the middle bob (311), and therefore motivating a design where the maximum moment of inertia $I(\phi_{max})$ is small. Of course, if the middle bob (311) happens to rotate about an axis having a small moment of inertia I during the string pass, the string (320) is not likely to tangle about the middle bob (311), therefore motivating a design where the minimum moment of inertia $I(\phi_{min})$ is small.

Furthermore, it might seem reasonable that a center of mass displaced from the bore axis (335) would produce the advantage of consistently orienting the middle bob (311) just prior to the string pass. For instance, for the exemplary mass distribution of FIG. 6.1, the mass m should always be located in the lower portion of the middle bob (311) just prior to the string pass. Therefore, if the middle bob (311) rotates in the horizontal plane as depicted in FIG. 5C, the moment of inertia I will be very small and the motion of the orbiting bobs (310) and (311) will be smooth. However, it has been found empirically that a center of mass displaced from the bore axis (335) produces an undesirable wobbling of the middle bob (311) which gives the orbits of the swinging bob toy (300) an unpleasant feel.

A useful measure of the location of the center of mass is the first vector moment $\vec{J}$ of distance $\vec{r}$ is given by $$\vec{J}=\int \rho \vec{r}\, d\tau, \tag{4.1}$$

where ρ is density, $\vec{r}$ is the distance vector originating from a central point on the bore axis (335), dr is the infinitesimal volume element, and the integration is performed over volume. Or, in terms of a number of point masses m1 at distances $\vec{r}_i$ from a central point on the bore axis (335), the first vector moment $\vec{J}$ is given by $$\vec{J}=\Sigma m_i \vec{r}_i. \tag{4.2}$$

According to the present invention, the ratio of the magnitude of the first vector moment $\vec{J}$ to the characteristic radius R, i.e., $(|\vec{J}|/mR)$, where m is the mass of the middle bob (311), is to be small. In the preferred embodiment of the present invention, the characteristic radius R is the arithmetic average of radii on the equatorial plane (237). However, according to alternate preferred criteria, the characteristic radius R may be a maximum, minimum, or average radius along the equatorial plane (237), the polar axis (235), or an intermediate direction, and the average used may be an arithmetic average, a geometric average, or a weighted average. In particular, according to the present invention the ratio of the magnitude of the first vector moment $\vec{J}$ to the product of the mass m and the characteristic radius R is less than 0.50, more preferably less than 0.40, still more preferably less than 0.30, even more preferably less than 0.20, still more preferably less than 0.10, still more preferably less than 0.05, still more preferably less than 0.025, and even more preferably less than 0.01.

It is important to note that a swinging bob toy (300) with a middle bob (311) with a non-cylindrically symmetric weight distribution having a small percentage moment variation V will have a more predictable, more consistent smoothness of motion than a swinging bob toy (300) with a middle bob (311) having a large percentage moment variation V. Therefore, according to the present invention the middle bob (311) of the swinging bob toy (300) is to have a small percentage moment variation V. Preferably, the percentage moment variation V is less than 66%, more preferably less than 50%, more preferably less than 40%, still more preferably less than 30%, even more preferably less than 20%, still more preferably less than 10%, still more preferably less than 5%, still more preferably less than 2.5%, and even more preferably less than 1%.

Arrangement of Functional, Internal Components

As discussed above, according to the present invention, functional, internal components are arranged so as to produce a small percentage moment variation V, and to have their collective center of mass near the mid-point of the bore axis (335). The exemplary arrangement of functional, internal components in the middle bob (311) depicted in FIG. 3C substantially fulfills these criteria given that the batteries (375) are heavier than the screw posts (371*a*) and (371*b*) and screws (not shown), and the screw posts (371*a*) and (371*b*) are heavier than the lights (377). As depicted in FIG. 3C, the batteries (375) are located at azimuthal angles $\phi=0°$ and $\phi=180°$ from the reference axis (399) at equal distances from the bore axis (335), the screw posts (371*a*) and (371*b*) are located at azimuthal angles $\phi=+90°$ and $\phi=-90°$ from the reference axis (399) at equal distances from the bore axis (335), and the lights (377) are located at azimuthal angles $\phi=+90°$ and $\phi=-90°$ from the reference axis (399) at equal distances from the bore axis (335). Furthermore, the center of mass of each of the functional components (375), (377), (371*a*) and (371*b*)—with the exception of the switch (380)—is located on the equatorial plane (337). (It will be recalled that a pair of lights (not shown) are also mounted on the bottom side of the circuit board (379) directly below the two lights (377) visible in FIG. 3C.) Also, the center of mass of the circuit board (379), and the center of mass of the outer shell (351) are located near the center of the bob (311).

Figures 1, 9:
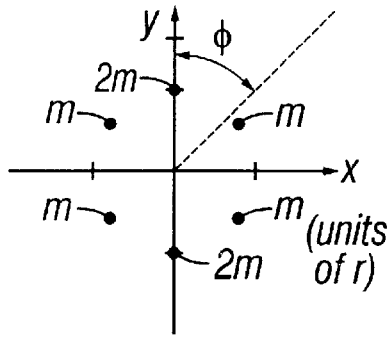
FIGS. 9.1 through 9.2 show balanced placements of six point masses, two of which having a mass of 2m, and four of which having a mass of m.
Figures 2, 9:
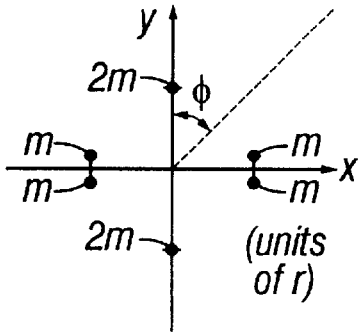
Figures 1, 10:
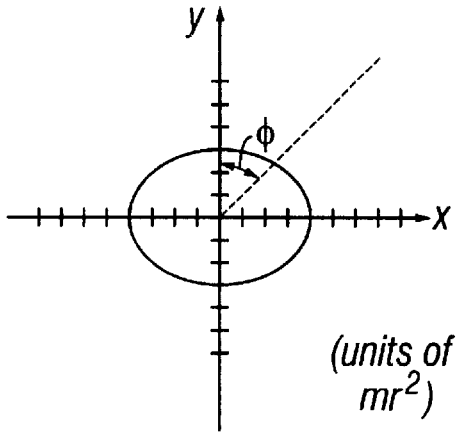
FIGS. 10.1 through 10.2 are polar plots of the moment of inertia I of the point masses of FIGS. 9.1 through 9.2 as a function of azimuthal angle $\phi$ of the axis of rotation.
Figures 2, 10:
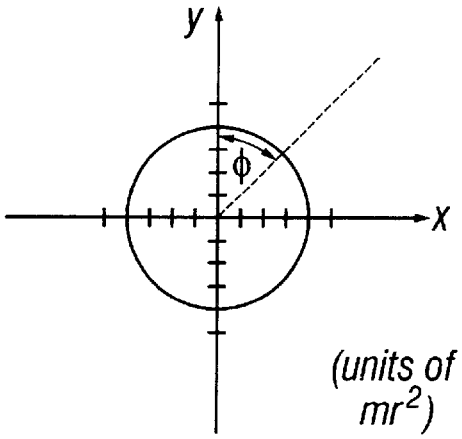

The motivation for the arrangement of the components of FIG. 3C may be clarified by considering the simple examples of six point masses shown in FIGS. 9.1 and 9.2, where there are two point masses having mass 2m, and four point masses having mass m. For the purpose of simplification and illustration it will be assumed that all the point masses must be located at a distance r from the origin. In the first arrangement shown in FIG. 9.1, the masses are located at the vertices of a hexagon with the two masses of mass 2m located at $\phi=0°$ and 180°, and the four masses of mass m located at $\phi=60°$, 120°, 240°, and 300°. In the second arrangement shown in FIG. 9.2, the masses are located near the vertices of a square with a mass of mass 2m located at $\phi=0°$, a mass of mass 2m located at $\phi=180°$, two masses of mass m located at roughly $\phi=90°$, and two masses of mass m located at roughly $\phi=270°$. As is illustrated by the corresponding polar plots of the moment of inertia $I(\phi)$ of FIGS. 10.1 and 10.2, the arrangement the masses shown in FIG. 9.1 has $I(\phi_{max}=90°)=4mr^2$ and $I(\phi_{min}=0°)=3mr^2$, and therefore the percentage moment variation V is 25%. However, for the arrangement the masses shown in FIG. 9.2, the moment of inertia I has a constant value of $I=4mr^2$, and therefore a percentage moment variation V of 0%. It is important to note that in both cases there is a 'balanced' weight distribution, i.e., a weight distribution which has its center of mass near the origin. A balanced weight distribution in no way insures that the percentage moment variation V will be 0%, or even that the percentage moment variation V will be small.

Because the screw posts (371*a*) and (371*b*) and lights (377) are lighter than the batteries (375) in the light-up version of the middle bob (311) shown in FIG. 3C, locating the screw posts (371*a*) and (371*b*), lights (377) and batteries (375) with six-fold symmetry about the polar axis (335), i.e., locating the screw posts (371*a*) and (371*b*), lights (377) and batteries (375) at the vertices of a hexagon, would not produce a moment of inertia $I(\phi)$ which is invariant with azimuthal angle $\phi$. That is, if the batteries (375) were located at $\phi=0°$ and 180°, the screw posts (371*a*) and (371*b*) were located at $\phi=60°$ and 240°, and the lights (377) were located at $\phi=120°$ and 300°, the moment of inertia $I(\phi)$ would be substantially greater at $\phi=+90°$ and $-90°$ than at $\phi=0°$ and 180°. Therefore, as shown in FIG. 3C, it is preferable to approximate a four-fold symmetry for the weight distribution by locating the batteries (375) at $\phi=0°$ and 180° at a distance r from the center of the bob (311), and locating the screw posts (371*a*) and (371*b*) and lights (377) at $\phi=90°$ and 270° at roughly the same distance r from the center of the bob (311). The screw posts (371*a*) and (371*b*), being heavier than the lights (377), and extending farther along the polar axis (335), are located nearer the center of the bob (311) than the lights (377), since the reverse arrangement would produce a greater contribution to the moment of inertia $I(\phi)$.

In a preferred embodiment of the present invention, the lights (377) can be made to flash at a number N of flashes per second that is rapid enough that the flashing cannot be detected by the human eye when the bobs (310) and (311) are stationary, but becomes detectable when the bobs (310) and (311) have a velocity v associated with normal play. This provides the dramatic effect that the flashing appears when play begins and the bobs (310) and (311) move, and the flashing ceases when play ceases and the bobs (310) and (311) stop moving. It should be noted that the effect of having the flashing of the lights (377) dependent on the motion would generally need to be accomplished by using an accelerometer to detect motion and control the signal to the lights (377). In contrast, according to the present invention no accelerometer is needed to make the flashing dependent on the motion of the bobs (310) and (311) since the rate of flashing N takes advantage of temporal and spatial resolution of the human eye. In particular, the rate of flashing N must be greater than roughly 10 flashes/second if the flashing is not to be detectable when the lights (377) are stationary. Furthermore, if the human eye can resolve spatial fluctuations in the brightness of the lights (377) down to a distance d when standing about 1 meter away, $\alpha$ is the fraction of a flash cycle which a light (377) is off, and the bobs' lights (377) have a velocity of v cm/sec during normal play, then the rate of flashing N must be less than $\alpha v/d$ if the flashing is to be detectable when the lights (377) are moving. Therefore, the rate of flashing N is required to satisfy the bounds $$10\ \text{Hz}<N<200\ \alpha v/d. \tag{5.1}$$

if the flashing is not to be detectable when the lights (377) are stationary, but visible when the lights (377) are moving. Given that the human eye cannot detect the flashing of the lights (377) in the swinging bob toy (300) if they are separated by an angle of less than roughly $5\times10^{-3}$ radians, if the viewer is a distance D from the swinging bob toy (300), then the bound of equation (5.1) for the rate of flashing N becomes $$10\ \text{Hz}<N<200\ \alpha v/D. \tag{5.2}$$

For a swinging bob toy (300) which has a string (320) of length l, the velocity v of the bobs (310) and (311) is generally on the order of $\sqrt{gl}$, where g is the acceleration due to gravity of 9.8 meters/second$^2$. (It should be noted that the length l of the string (320) of relevance is the effective length, i.e., the length from where the string (320) is held by the player to the end bob (310).) Therefore, the bound of equation (5.2) for the rate of flashing N becomes $$10\ \text{Hz}<N<200\ \alpha\sqrt{gl}/D. \tag{5.3}$$

More preferably, the bound for the rate of flashing N is $$20\ \text{Hz}<N<100\ \alpha\sqrt{gl}/D, \tag{5.4}$$

still more preferably $$30\ \text{Hz}<N<50\ \alpha\sqrt{gl}/D, \tag{5.5}$$

and most preferably $$40\ \text{Hz}<N<25\ \alpha\sqrt{gl}/D. \tag{5.5}$$

For instance, for a player playing with a swinging bob toy (300) where the time on and off of the flashing light (377) is equal (i.e., $\alpha=0.5$), and where the string (320) has a length of approximately 1 meter, the player is then roughly 1 meter from the bobs (310) and (311) during normal play, and equations (5.3), (5.4), and (5.5) become $$10\ Hz<N<313\ Hz. \tag{5.3.1}$$

$$20\ Hz<N<156\ Hz, \tag{5.4.1}$$

and $$30\ Hz<N<78\ Hz, \tag{5.5.1}$$

respectively. Most preferably, the rate of flashing N is roughly 40 flashes per second. However, for a performer playing with a swinging bob toy (300) with a rope or string (320) of 3 meters (for instance, while walking on stilts or performing from a crane) for an audience members who are roughly 10 meters away, where the time on and off of the flashing light (377) is equal, equations (5.3) and (5.4) become $$10\ Hz<N<54\ Hz. \tag{5.3.1}$$

and $$20\ Hz<N<27\ Hz, \tag{5.4.1}$$

respectively.

According to the preferred embodiment of the present invention, depressing the switch (380) cycles the circuitry controlling the lights (377) through at least three states:

(1) lights (377) off, (2) lights (377) on, but not flashing, and (3) lights (377) on and flashing in a manner described above.

It should be noted that it is, to an extent, disadvantageous to have the second and third states not be visually distinguishable when the user is using the switch (380) to switch between states. However, the above-described advantage of providing a dramatic difference in appearance when the circuitry is in the third state and the bobs (310) and (311) begin to move is a substantial advantage which, according to the present invention, outweighs the above-described disadvantage.

Thus, it will be seen that the improvements presented herein are consistent with the objects of the invention for a swinging bob toy described above. While the above description contains many specificities, these should not be construed as limitations on the scope of the invention, but rather as exemplifications of preferred embodiments thereof. Many other variations are within the scope of the present invention. For example: the swinging bob toy may have one or two end bobs; the swinging bob toy may have a non-cylindrically symmetric weight distribution, but not have functional components other than structural components, such as struts, ribs, means for attachment of the hemispheres, means for securing a central weight, etc.; the exterior surface of a bob may not be substantially spherical; the exterior surface of a bob may not have cylindrical symmetry; the bore through a bob may not have cylindrical symmetry; a bob may have more or fewer batteries, lights, switches and screw posts; pressing the switch may cycle the lights through more than or less than three states; a bob may have the batteries, lights, switches and screw posts arranged in another configuration; the amount of time which a flashing light is on may differ from the amount of time which a flashing light is off; the bobs may be in electrical communication with each other; a bob may include a circuit to produce time-variation in the colors of a light or lights; the functional components may include sound-producing components; the functional components may include sound-producing components, and motion detecting components to control the sound-producing components; the functional components may include sound-producing components which are designed to take advantage of doppler effects produced by the motions of the bobs; a swinging bob toy with functional components may or may not include a moment-of-inertia-reducing high-density central weighting; the relative weights of batteries, screw posts, lights, switches, and other components may differ from those described; functional components need not be located internally; etc.

Furthermore, the description of the physical principles underlying the operation and performance of the present invention are described as presently understood, but are not intended to be limiting. It should also be understood that these physical descriptions may include approximations, simplifications and assumptions. For instance, for a middle bob having a large percentage moment variation or a small percentage moment variation, the rotation of a middle bob during the string pass may be simpler or more complicated than described, may differ from what is described, or its behavior may have a physical explanation other than what is described.

Accordingly, it is intended that the scope of the invention is determined not by the embodiments illustrated or the physical analyses motivating the illustrated embodiments, but, rather, by the appended claims and their legal equivalents.

What is claimed is:

1. A swinging bob toy comprising:

a flexible, elongated tethering means;

a first end bob attached at a first end of said tethering means; and a second bob having a bore therethrough along a polar axis normal to an equatorial plane, said tethering means passable through said bore, a mass distribution of said second bob lacking cylindrical symmetry about said polar axis, said second bob having a moment of inertia $I(\phi)$ as a function of azimuthal angle $\phi$ of an axis of rotation in said equatorial plane, said mass distribution having a maximum moment of inertia $I(\phi_{max})$ about a first axis in said equatorial plane at a first azimuthal angle $\phi_{max}$, and having a minimum moment of inertia $I(\phi_{min})$ about a second axis in said equatorial plane at a second azimuthal angle $\phi_{min}$, a percentage moment variation V being given by $$V=100\times[(I(\phi_{max}))-(I(\phi_{min}))]/(I(\phi_{max})),$$

said percentage moment variation V having a value less than 66%, and said mass distribution having a center of mass located near a mid-point of said bore.

2. The swinging bob toy of claim 1 wherein said percentage moment variation V is less than 50%.

3. The swinging bob toy of claim 1 wherein said percentage moment variation V is less than 40%.

4. The swinging bob toy of claim 1 wherein said percentage moment variation V is less than 30%.

5. The swinging bob toy of claim 1 wherein said percentage moment variation V is less than 20%.

6. The swinging bob toy of claim 1 wherein said percentage moment variation V is less than 10%.

7. The swinging bob toy of claim 1 wherein said percentage moment variation V is less than 5%.

8. The swinging bob toy of claim 1 wherein said percentage moment variation V is less than 2.5%.

9. The swinging bob toy of claim 1 wherein said percentage moment variation V is less than 1%.

10. The swinging bob toy of claim 1 wherein said second bob includes functional components and said functional components contribute to said lacking of said cylindrical symmetry.

11. The swinging bob toy of claim 10 wherein said second bob includes outer shell sections and an equatorially-located functional-components mounting element, and said functional components which are not integral with said outer shell sections are mounted on said functional-components mounting element.

12. The swinging bob toy of claim 10 wherein a mass distribution of said functional components about said polar axis has substantially an n-fold symmetry, where n is an integer greater than or equal to 3.

13. The swinging bob toy of claim 10 wherein said functional components include a battery and a light powered by said battery.

14. The swinging bob toy of claim 13 wherein said functional components further include a switch controlling power from said battery to said light.

15. The swinging bob toy of claim 10 further including a centrally-located, high-density weight.

16. The swinging bob toy of claim 1 further including a centrally-located, high-density weight.

17. The swinging bob toy of claim 1 further including a third bob attached at a second end of said tethering means opposite said first end of said tethering means.

18. The swinging bob toy of claim 1 wherein said second bob has a characteristic radius R, a mass m, and a mass distribution ρ, and a first vector moment $\vec{J}$ of vector distance $\vec{r}$ from a mid-point of said polar axis given by an integration over volume elements dr according to $$\vec{J}=\int \rho \vec{r}\, d\tau,$$

and a ratio of a magnitude of said first vector moment $\vec{J}$ to a product of said mass m and said characteristic radius R has a value less than 0.50.

19. The swinging bob toy of claim 18 wherein said ratio has a value less than 0.40.

20. The swinging bob toy of claim 18 wherein said ratio has a value less than 0.30.

21. The swinging bob toy of claim 18 wherein said ratio has a value less than 0.20.

22. The swinging bob toy of claim 18 wherein said ratio has a value less than 0.10.

23. The swinging bob toy of claim 18 wherein said ratio has a value less than 0.05.

24. The swinging bob toy of claim 18 wherein said ratio has a value less than 0.025.

25. The swinging bob toy of claim 18 wherein said ratio has a value less than 0.01.

26. The swinging bob toy of claim 10 wherein said second bob has a characteristic radius R, a mass m, and includes outer shell sections and a functional-components mounting element, said functional components which are non-integral with said outer shell sections being mounted on said functional-components mounting element, said functional-components mounting element having a mass $m_i$, a center of mass located at vector distance $\vec{r}$ from a mid-point of said polar axis, and a vector moment $\vec{J}$ given by $$\vec{J}=m_i \vec{r},$$

and a ratio of a magnitude of said vector moment $\vec{J}$ to a product of said mass m and said characteristic radius R being less than 0.20.

27. The swinging bob toy of claim 26 wherein said ratio of said magnitude of said vector moment $\vec{J}$ to said product of said mass m and said characteristic radius R is less than 0.10.

28. The swinging bob toy of claim 26 wherein said ratio of said magnitude of said vector moment $\vec{J}$ to said product of said mass m and said characteristic radius R is less than 0.05.

* * * * *